United States Patent [19]

Harris, Jr. et al.

[11] Patent Number: 4,552,603

[45] Date of Patent: Nov. 12, 1985

[54] METHOD FOR MAKING BICOMPONENT FIBERS

[75] Inventors: Robert D. Harris, Jr.; James P. Parker; Charles L. King, all of Asheville, N.C.

[73] Assignee: Akzona Incorporated, Enka, N.C.

[21] Appl. No.: 423,943

[22] Filed: Sep. 27, 1982

Related U.S. Application Data

[62] Division of Ser. No. 279,125, Jun. 30, 1981, abandoned.

[51] Int. Cl.[4] ..... D01D 5/22

[52] U.S. Cl. ..... 156/167; 264/168; 264/174; 264/235.6; 264/DIG. 75; 428/296; 428/373; 156/181; 156/290

[58] Field of Search ..... 264/168, 171, 248, DIG. 75, 264/342 R, 345, 291, 210.5, 289.6, 290.5, 174, 235.6; 428/296, 373, 474.9; 156/167, 181, 290

[56] References Cited

U.S. PATENT DOCUMENTS

| | | | |
|---|---|---|---|
| 3,511,747 | 5/1970 | Davies | 428/296 |
| 3,595,731 | 7/1971 | Davies et al. | 428/474.9 |
| 3,998,988 | 12/1976 | Shimomai et al. | 428/373 |
| 4,189,338 | 2/1980 | Ejima et al. | 156/167 |
| 4,211,816 | 7/1980 | Booker et al. | 428/296 |

FOREIGN PATENT DOCUMENTS

| | | | |
|---|---|---|---|
| 846761 | 7/1970 | Canada | 264/DIG. 75 |
| 51-64075 | 6/1976 | Japan | 264/DIG. 75 |
| 1343449 | 1/1974 | United Kingdom | 264/DIG. 75 |

*Primary Examiner*—Donald Czaja
*Assistant Examiner*—Hubert C. Lorin
*Attorney, Agent, or Firm*—Jack H. Hall; Alan R. Stempel; Francis W. Young

[57] ABSTRACT

Novel heat bondable bicomponent fibers useful in the production of nonwoven fabrics, as well as methods for the production of such fibers, are disclosed. The fibers comprise a latently adhesive component for forming interfilamentary bonds upon the application of heat and subsequent cooling, and another component, and are characterized by the fact that upon the application of heat sufficient to melt the latently adhesive component and subsequent cooling, a substantial shrinkage force appears in said other component only after resolidification of said latently adhesive component.

7 Claims, 3 Drawing Figures

METHOD FOR MAKING BICOMPONENT FIBERS

This is a division of application Ser. No. 279,125, filed June 30, 1981, now abandoned.

BACKGROUND OF THE INVENTION

1. Field of the Invention

This invention relates to heat bondable heterofilaments and to nonwoven fabrics made therefrom.

2. Description of the Prior Art

The use of heat bondable heterofilaments in the manufacture of nonwovens is well known in the prior art. Generally, such heterofilaments comprise two thermoplastic materials which are arranged in either side-by-side or sheath/core relationship with the two materials being coextensive along the length of the filament. One of the thermoplastics, a so-called latent adhesive, is selected so that its melting point is significantly lower than that of the other in the filament, and, by the application of heat and subsequent cooling, this component is made to become adhesive and bond to other fibers in the nonwoven. Such adhesion can take place either between like heterofilaments of between heterofilaments and conventional non-bonding filaments if these are also present in the nonwoven. The other component serves as a structural or backbone member of the fiber.

Although heat bondable heterofilaments were developed for use primarily in the production of light weight nonwovens, that is, nonwovens having relatively little weight per unit of area, they have achieved a somewhat limited commercial success in this area due to a number of deficiencies which are present in state of the art fibers. Foremost among these deficiencies are excessive shrinkage during thermal bonding, which leads to fabrics having an uneven density and non-uniformity of thickness; insufficient fiber-to-fiber bond strength, which leads to poor fabric tensile strength, as well as the production of nonwoven fabrics which are relatively lacking in such traditionally desirable textile qualities as drape, liveliness and bulk or loft.

Admittedly, an attempt has been made in the prior art to deal with the above-mentioned deficiencies. Tomioka, in an article entitled "Thermobonding Fibers for Nonwovens", Nonwovens Industry, May 1981, pp. 23–31, describes the properties of ES Fiber, bicomponent material commercially available from Chisso Corporation of Osaka, Japan. This fiber, which comprises polyethylene and polypropylene in a so-called modified "side-by-side" arrangement (actually a highly eccentric sheath/core), is also, presumably, disclosed in U.S. Pat. No. 4,189,338, to Ejima et al. and assigned to Chisso Corporation. Among the attributes of this fiber, Tomioka deals most extensively with the relatively low thermal shrinkage which the fiber experiences during the thermal bonding step, and goes on to note that this property results in nonwovens which possess good uniformity of density and thickness, as well as good bulk, hand and drape.

While it is certainly the case that the fiber described by Tomioka represents a substantial improvement in the state of the heat-bondable fiber art to date, this prior art fiber nonetheless suffers from several shortcomings. For example, while the fiber does indeed exhibit an amount of thermal shrinkage which is less than that of earlier fibers, it can be demonstrated that the fiber nevertheless still shrinks to a substantial and undesirable degree. Furthermore, although the elimination of thermal shrinkage represents a good theoretical approach to the improvement of heat bondable fibers, it is believed that this approach does not go far enough.

It will be recognized that while thermal shrinkage per se may be undesirable in a heat bondable fiber, the development of shrinkage force in a nonwoven, brought about subsequent to the creation of interfilamentary bonds may, in fact, be desirable. It is reasonable to assume that shrinkage force, introduced at this time, will not produce any substantial amount of actual shrinkage, but will, rather, remain as a trapped tension in the nonwoven which will enhance such fabric properties as bulk, liveliness, drape and hand.

Accordingly, it is the general object of the present invention to provide improved heat bondable heterofilaments which are useful for the production of nonwoven fabrics, particularly light and medium weight nonwovens, as well as a method for manufacturing such fibers.

It is a more specific object of the invention to provide heat bondable heterofilaments which may be used to produce nonwovens which exhibit minimal thermal shrinkage during thermal bonding but which also exhibit enhanced fabric tensile strength, liveliness, drape, bulk and hand after bonding.

A still more specific object is to provide a heat bondable heterofilament which does not experience substantial shrinkage force, and hence shrinkage, prior to or during thermal bonding, but which does develop substantial shrinkage force subsequent to the formation of interfilamentary bonds in a nonwoven.

It is a further object to provide a method for manufacturing heat bondable heterofilaments whereby the thermal characteristics of said fiber can be adjusted or altered to meet specified requirements.

Finally, it is an object of the invention to provide nonwovens manufactured from these novel heterofilaments, with said nonwovens being producible at high rates and with modest energy consumption and having enhanced properties.

SUMMARY OF THE INVENTION

In furtherance of the aforementioned objects, it has now been discovered that improved heat bondable heterofilaments, for use in either staple or filament form in the manufacture of nonwovens, may be produced from polyester and another suitable thermoplastic polymer having a melting point which is at least about 15° C. below that of polyester, wherein polyester is the backbone polymer and the other thermoplastic component serves as the latent adhesive. The two components may be arranged in side-by-side relationship, i.e., collinearly, but preferably they are arranged in sheath/core relationship with polyester occupying the core. Subsequent to the usual steps of spinning, drawing and winding, a heterofilament prepared in accordance with the invention is subjected to a thermal conditioning step. This step involves heating the fiber at a preselected temperature for at least a preselected time so that a change is brought about in the thermal response of the fiber such that the fiber becomes characterized by the fact that upon the application of heat sufficient to melt the latently adhesive component and subsequent cooling, a substantial shrinkage force appears in the polyester component only after the resolidification of the latently adhesive component. The temperature at which shrinkage force does appear is termed the "conditioned response temperature". The precise parameters of temperature and time which must be employed to properly condition a fiber in the manner described above cannot be given as a general matter. As will be seen from the further description to follow, the parameters required for thermal conditioning will be governed by such things as the prior thermal history of the particular fiber being used and the temperature at which the nonwoven is to be thermally bonded, which, in turn, will be determined by the particular latently adhesive component being employed.

It has been observed that with fibers prepared in accordance with the invention, interfilamentary bonds are enabled to form between fibers before the development of shrinkage forces therein. As explained in greater detail hereinafter, this property is believed to enhance the strength of the interfilamentary bonds in a nonwoven fabric, and, further, to contribute to a superior drape, hand, bulk and liveliness in the fabric.

As a still further attainment of the objects, it has been found that nonwoven fabrics may be prepared from the heterofilaments of the invention, and that this can be done using relatively uncritical processing conditions.

DETAILED DESCRIPTION OF THE PREFERRED EMBODIMENTS

Figure 1:
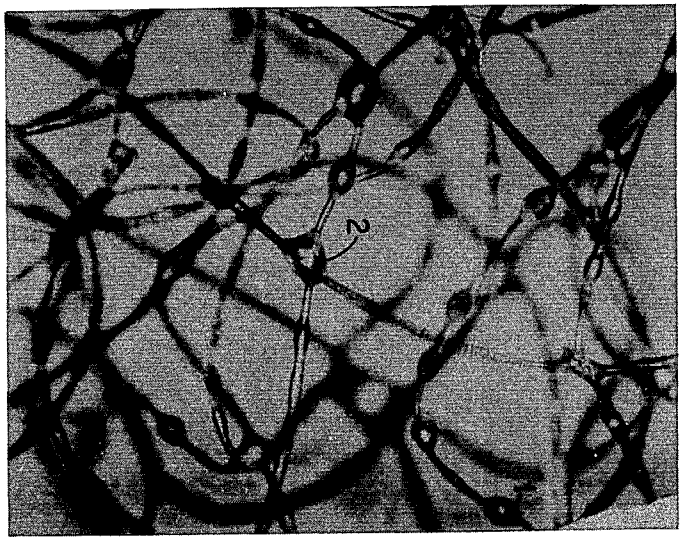
FIG. 1 is a photomicrograph of a nonwoven prepared from the heterofilaments of the invention illustrating the interfilamentary point bonding present in the fabric.

A photomicrograph of a non-woven fabric manufactured from the fibers of this invention is shown in FIG. 1. In the production of such a fabric, the fibers are formed into a web and subjected to heating sufficient to activate the latent adhesive element, and the cooling to solidify the bonds (2) that have been formed by the molten adhesive at the intersections of the individual filaments.

Because it may be assumed that the thermo-mechanical behavior of bicomponent fibers subjected to such a heating and cooling cycle will affect both the nature of the bonds formed as well as the general character of the resulting fabric, it is appropriate to characterize these fibers by some type of thermo-mechanical analysis. Accordingly, the fibers of the present invention were investigated using a technique known as Thermal Stress Analysis (TSA). In this technique, a sample is held at a constant length while its temperature is changed, and the resulting tensile forces developed in the sample are recorded as a function of temperature. This TSA method is discussed in an article by Buchanan and Hardegree in the Textile Research Journal, November 1977, p. 732. However, as far as is known, these authors, as well as others who have published results from this technique, have concentrated solely on the reactions of the sample to increasing temperatures only. In contrast, the studies of this invention have put equal emphasis on the sample reaction during the cooling portion of the test, since it seemed appropriate for the proper simulation of the complete thermal treatment given to a nonwoven material in its fabrication, as described above.

In the preparation of samples for this study, a sufficient number of individual fibers were mounted together to make a bundle with an equivalent denier in the range of 100 to 500. The mounting system used was that prescribed by the Perkin-Elmer Co., of Norwalk, Conn., for use with their thermo-mechanical analyzer, designated TMS-1. A standard pre-tension of 0.02 gm/den was selected to improve uniformity of testing. The temperature was increased at a rate of approximately 15° C./min in all tests.

Figure 2:
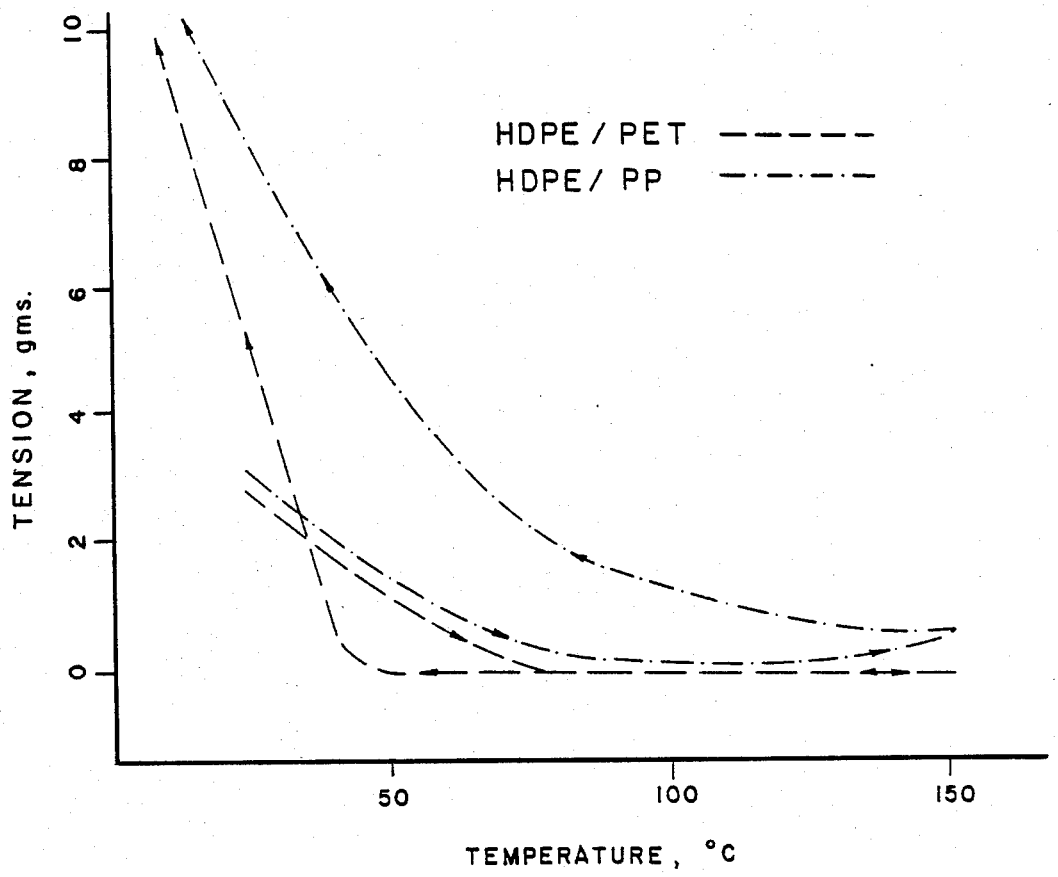
FIG. 2 is a graph depicting shrinkage force in the polyester component of a heterofilament of the invention as a function of temperature, as compared to the shrinkage force in the polypropylene component of a prior art fiber.

FIG. 2 gives representative results of a TSA test of fibers of the invention, in this case designated as high density polyethylene/polyester, in comparison with the prior art fibers, designated as high density polyethylene/polypropylene. The tension in the sample is plotted on the vertical, or "Y" axis, and the temperature of the sample is plotted on the horizontal, or "X" axis. The arrows on the curves show how the changes progressed with time. Starting with test samples of 200 denier, a pretension of 4 grams is applied at room temperature, and the sample length is held constant for the rest of the test. As the temperture is increased, this pre-tension is seen to decay to essentially zero in both cases, resulting from the normal relaxation and thermal expansion shown by materials in general. After this relaxation of the initial pre-tension, however, the two samples tested show quite different thermal-stress behavior. The prior art sample high density polyethylene/propylene shows an increase in tension as the temperature increases to 150° C., and, more significantly, a rapid increase in tension as the sample is cooled. It should be emphasized that this tension build-up on heating, and the subsequent rapid tension increase on cooling is regarded as undesirable in the production of non-woven structures. In contrast to this pattern, the sample of the subject invention shows no increase in tension, either in the heating stage or in the cooling stage, until the assembly of fibers forming the bundle has cooled sufficiently to ensure that, were the fibers in a web, inter-fiber bonds would have solidified without shrinkage forces being applied to these newly-formed bonds.

It is apparent that the temperature at which tension begins to develop as the sample is cooled is of primary importance in distinguishing the fibers of this invention. As a means of determining this temperature, we have defined the onset of tension build-up as that temperature at which the tension exceeds a threshold value of 0.01 gms/den, based on the denier of the backbone component. This value was selected as being of low as practical but still clearly distinguishable over the instrumental background variations in the recorded tension. As an example, a 50/50 composition sample formed into a 300 denier bundle for testing, as described above, will compare only a 150 denier backbone fiber, and its threshold tension value will be 1.5 gms.

Figure 3:
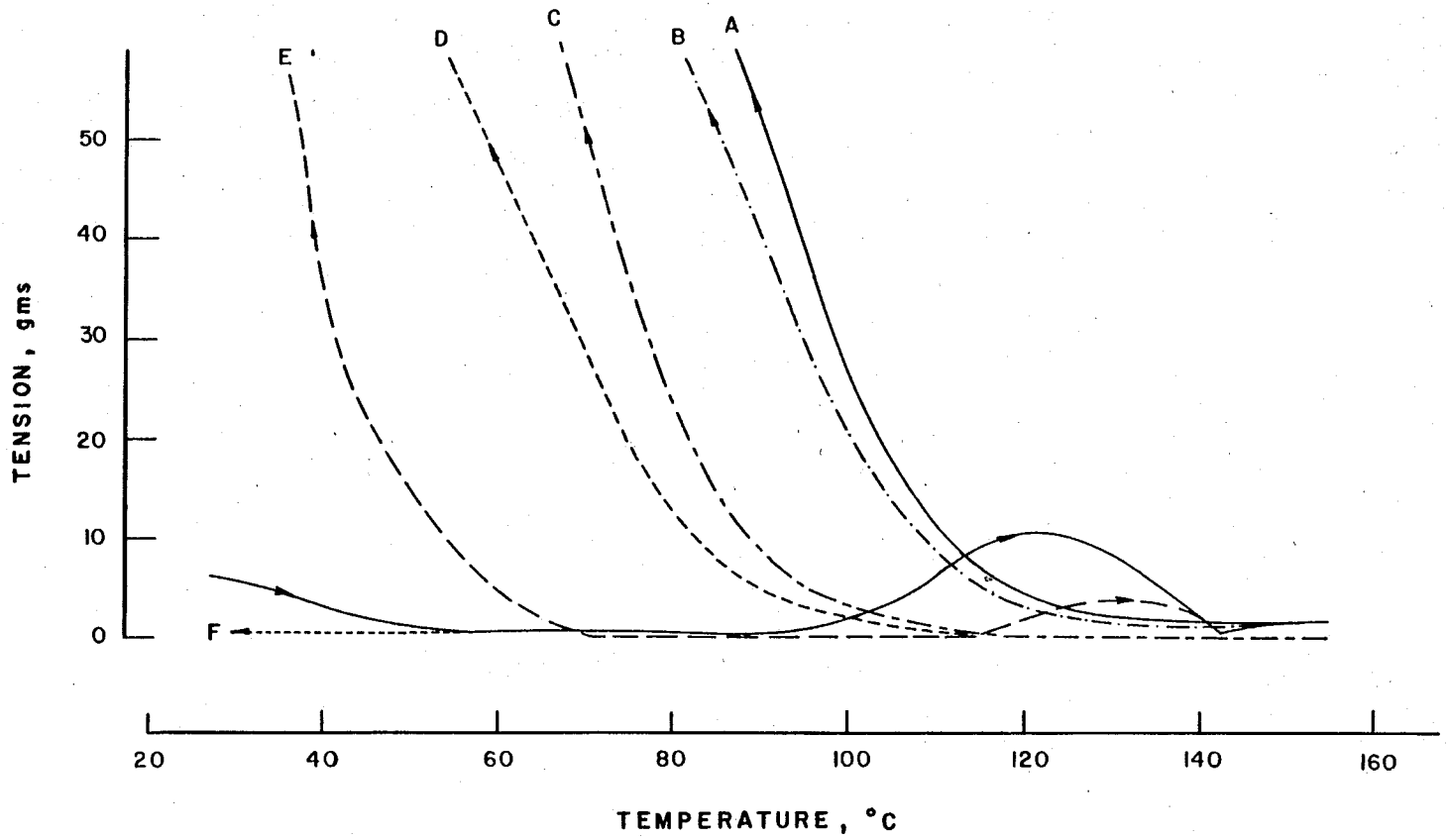
FIG. 3 is a graph depicting the effect of thermal conditioning upon the shrinkage force response of a heterofilament fiber having a polyester component.

As a means of showing how fibers having this desired cooling curve are produced, FIG. 3 shows the results obtained when several conditioning treatment are applied to fibers produced by one common spinning and drawing scheme. Table 1 below lists the different conditioning treatments used, and FIG. 3 is a composite of the TSA curves of these several different samples, each with its own thermal conditioning treatment;

TABLE 1

| Sample | Conditioning Treatment |
|---|---|
| A | None |
| B | 3 minutes at 90° C. |
| C | 3 minutes at 100° C. |
| D | 3 minutes at 110° C. |
| E | 3 minutes at 120° C. |
| F | 3 minutes at 130° C. |

As in FIG. 2, the tension is plotted on the vertical scale, but in this case, the scale is different from that of FIG. 2, and the initial pre-tension of 6 gms is seen in the lower left portion of the diagram. All samples show the same decrease in this tension as the temperature increases at the beginning of the test. Beyond this initial heating phase, the different samples are easily distinguished from one another.

It will be noted that Sample A, which received no heat treatment subsequent to drawing, shows a build-up of tension as the temperature increases to about 100° C., reaching a peak at approximately 120° C. and decreasing to a minimum (but not zero-level) at 140° C. This is typical of a polyester, and is described in Buchanan and Hardegree in the reference cited. On cooling, this sample shows an increase in tension at the beginning of cooling, with a rapid increase below 130° C. Actually, this sample exhibits a tension exceeding the threshold value of 0.01 gm/denier throughout its high temperature residence; consequently, it cannot be given a value for the start of tension build-up.

Sample B, which was treated for 3 minutes at 90° C., shows a substantial reduction in the tension peak during the heating portion of the curve, and a tension build-up curve on cooling just a little below that of sample A.

Samples C, D, and E show no tension on heating, and only develop an appreciable tension when they have cooled well below the temperature of re-solidification of the sheath material. These samples are representative of fibers prepared in accordance with the invention.

Sample F illustrates the fact that a heat treatment that is too severe can completely eliminate any tendency to develop a tension on cooling.

Without wishing to be bound by any particular theory, it is believed that in nonwovens made from fibers produced in accordance with the invention, the strength of interfilamentary bonds, such as the fillets 2 of FIG. 1, is enhanced by the fact that when the fibers are heated, in order to melt the sheaths thereof, and, subsequently, cooled to solidify the bonds therebetween, little or not tensile force develops in the fibers until the temperature has dropped below the solidification range of the sheath and such bonds have already formed. That is, to say, it is believed that with the fiber of the invention, bonds are formed in an unstressed state, a condition which enhances interfilamentary bond strength. In comparison, tensile forces do develop in the prior art fiber prior to the formation of relatively weak bonds.

Again, without wishing to be bound by any theories expressed, it is further believed that the development of tension or shrinkage force in fibers according to the invention, after the formation of interfilamentary bonds, serves to enhance various textile qualities in nonwovens made from the fiber. Thus, it is theorized that the unique thermomechanical behavior of the novel fiber functions to trap tension in the nonwoven fabric and it is believed that this tension is, at least in part, responsible for the pleasing liveliness, drape, bulk and hand possessed by nonwovens made from fibers produced in accordance with the invention.

Turning now to a more detailed description of the composition and preparation of the fibers which are the subject of the present invention, reference is made to the several examples which follow which describe the preparation of a number of such fibers. In each case, a heat bondable bicomponent filament was produced wherein the structure of backbone polymer was polyester. The latently adhesive components used were, in each case, selected from the group comprising polyethylene and polypropylene of fiber forming grade, although it is to be assumed that other polymers having melting points at least about 15° C. below that of polyester would serve equally well for this purpose.

The fibers in each of the examples are of a sheath-/core configuration wherein the polyester component occupies the core location and in each case the sheath and the core are in eccentric relationship. Both eccentric and concentric sheath/core arrangements were utilized. It is to be understood, however, that bicomponent fibers having side-by-side configurations are also considered to be within the scope of the invention.

Particular note will be paid to the fact that very different thermal conditioning parameters were utilized with respect to each of the fibers in the examples, but that the thermomechanical responses exhibited by the various fibers after conditioning were substantially the same; that is, each was characterized by the fact that upon the application of heat sufficient to melt the latently adhesive component and subsequent cooling, substantial shrinkage force appeared in the polyester component only after the resolidification of the latently adhesive component. A precise description of the parameters required for proper thermal conditioning cannot be given, and it will be noted from the examples that these parameters are governed by such things as the prior thermal history of the particular fiber being used; the temperature at which the nonwoven is to be bonded, which, in turn, will be determined by the particular latently adhesive component being employed; and, also by the amount of shrinkage force desired in the fiber. As a general rule, it can be stated that there appears to be a direct relationship between the melting point of the latently adhesive component and the thermal conditioning temperature which is required, fibers with high melting point adhesives requiring higher thermal conditioning temperatures. It is believed, although exact guidelines cannot be given, that the precise parameters for conditioning any given fiber can be determined with the aid of this disclosure with minimal experimentation.

Finally, it will be noted that there is considerable scatter in the "conditioned response temperatures" given for the various samples of the fibers in each example. Such variation should be considered as typical for staple fiber samples.

The following examples will illustrate the invention:

EXAMPLE 1

A staple fiber consisting of a sheath composed of a 42 Melt Index high density polyethylene (Fortiflex F-381 obtained from Soltex Polymer Corp.) having a molecular weight of 46,000 and a narrow molecular weight distribution (dispersity) of about 3.6 (high density polyethylene), and a core consisting of a standard fiber grade of semi-dull polyester was spun in an eccentric sheath/core arrangement into a fiber of about 50% by weight of high density polyethylene and 50% by weight of polyester. The high density polyethylene used had a density of 0.96 gr/cc, the polyester had a density of 1.38 gr/cc, and the conjugate fiber had a density of 1.12 gr/cc. The melting point of the high density polyethylene is 132° C. The melting point of the polyester is about 260° C.

The two polymers were melted in separate screw extruders, and fed through separate polymer lines and pumpblocks into the spinneret. The high density polyethylene was brought to a temperature of 265°-270° C. in the extruder, conducted through a pump and into the spinneret. The polyester was brought to a temperature of 285° C. in its extruder and conducted through a pump and into the spinneret. Inside the spinneret, the polymers were initially introduced to each other just prior to entering the capillary opening for extruding the filaments. Once the polyethylene melt contacted the polyester melt, its temperature jumped to about 285° C. for a short time period before being cooled and solidified in the blow box. In spinning for a 3.0 dpf staple, each component was metered to the spinneret at 0.583 grams/minute/hole, or a total throughput for both polymers of 1.166 grams/minute/hole. Each of the spinneret holes had a diameter of 400$\mu$. The filaments, still in tow form, were cooled, a spin finish, conventional for polyolefins, was applied by a water wheel, and the tow wound at 1752 meters/min. The filaments were drawn in two stages in order to develop maximum orientation and fiber properties; the draw ratio in the first stage being 1.05, with draw being conducted at room temperature and the draw ratio in the second stage being 2.50, with draw being conducted in steam so that the tow temperature was 80° C., the total draw ratio thus being 2.62. During drawing, the tow developed a spontaneous, curly crimp, when tension is released, because of a difference in tensions between the two polymer phases, which is not permanent. The tow was crimped, for aid in processing as a staple fiber by conventional stuffer box crimping. After crimping, the fiber was subjected to a thermal conditioning treatment by heating, under no tension, in a forced air oven at 230° F. (110° C.) for 240 seconds. The fiber was then cut into 1½-inch staple fiber having the following properties:

Denier—3.00 dpf
Tenacity—3.29 gpd
Elongation—55.9%
Crimp/Inch—24

Seven examples of this fiber were prepared, and, following the testing procedure outlined hereinbefore, each subjected to a thermal stress analysis. The peak temperature reached during the test procedures was 150° C., a temperature around which the particular fiber might typically be bonded into a nonwoven. In the case of each sample, no significant increase in shrinkage force was noted in the fiber bundle during the heating phase of the test. Each sample did, however, experience a marked development of tensile force during the cooling phase. The conditioned response temperature, that is, the temperature at which a shrinkage force equal to the threshold force of 0.01 grams per denier was first observed upon cooling of the fiber, is given below for each of the samples.

| Sample | Conditioned Response Temperature |
|---|---|
| 1 | 80° C. |

-continued

| Sample | Conditioned Response Temperature |
|---|---|
| 2 | 70° C. |
| 3 | 52° C. |
| 4 | 33° C. |
| 5 | 48° C. |
| 6 | 86° C. |
| 7 | 88° C. |

EXAMPLE 2

A sample of the staple fiber of Example 1 was hand formed into a matt and passed through a lab carding machine. The resulting web was rolled to give 4 plies. The sample was then compressed into a batt at 2000 psi on a 6" ram after 5 minutes was removed and trimmed. The batt was thermally bonded by placing the sample into a forced draft oven at 145° C. for 90 seconds. Other samples were prepared in the same way at 60 and 120 seconds. The samples all had considerable structural integrity as evidenced by their recovery from a small elongational stress placed by hand on the batt. The samples also exhibited a high degree of resilience and liveliness, which is demonstrated by observing the recovery to the original volume after being squeezed by small compressive forces, e.g., by hand pressure. The handle of these fabrics was soft and lofty.

EXAMPLE 3

A sample was spun substantially as in Example 1, except that a draw ratio of 1.10 was utilized in the first drawing stage and a draw ratio of 2.136 was utilized in the second drawing stage. The staple fiber thus prepared had the following properties:

Denier—2.97 dpf
Tenacity—3.43 gpd
Elongation—54%
Crimp/inch—23

Four samples of this fiber were prepared and subjected to thermal stress analysis, as in Example 1. Again, no significant shrinkage force was noted in any of the samples during the heating phase of the tests, but shrinkage force was noted during the cooling phase. The conditioned response temperatures for the four samples are given below.

| Sample | Conditioned Response Temperature |
|---|---|
| 1 | 98° C. |
| 2 | 111° C. |
| 3 | 78° C. |
| 4 | 62° C. |

EXAMPLE 4

Another sample was spun exactly as in Example 1, except that a different spinneret was used to make symmetrical sheath/core filaments. The total draw ratio was 2.28. The staple fiber values were:

3.03 dpf
3.28 gpd tenacity
43.2% elongation
16 crimps/inch
1.5" fiber length

Two samples of this fiber were prepared and subjected to thermal stress analysis, as in Example 1. Again, no significant shrinkage force was noted in either of the samples during the heating phase of the tests, but shrinkage force was noted during the cooling phase. The conditioned response temperatures for the two samples are given below:

| Sample | Conditioned Response Temperature |
|---|---|
| 1 | 87° C. |
| 2 | 64° C. |

A nonwoven fabric from the fiber obtained above was made in substantially the same manner as Example 2. The fabric had substantially the same properties as the nonwoven of Example 2.

EXAMPLE 5

A staple fiber consisting of the high density polyethylene and the polyester of Example 1, arranged in an eccentric sheath/core relationship at 50% by weight of sheath and 50% weight of core was spun from separate screw-pressure melters for each polymer. In spinning, each polymer was metered to the spinneret at the rate of 0.501 grams/minute/hole, or a total throughput for both polymers of 1.002 grams/minute/hole. Each spinneret hole had a diameter of 250μ. The filaments, in tow form, were cooled, a spin finish conventional for polyolefin was applied by water wheel, and the tow wound at 1000 m/min. The filaments were drawn through a water bath at 50° C. to a ratio of 4.53 to develop maximum orientation and fiber properties. The tow was crimped by conventional stuffer box crimping, then treated under no tension in forced air heat for 200 seconds at 100° C. to develop the conditioned response desired, in addition to stabilizing the crimp. The fiber, cut into 1½ inch staple, has typical values as follows:

Denier—3.06 dpf
Tenacity—3.62 gpd
Elongation—49%
Crimp/Inch—18

Six examples of the fiber thus prepared were subjected to thermal stress analysis, as in Example 1. No substantial tensile forces developed in any of the samples during the heating phase of the tests, but tension did develop in all cases during the cooling phase after the fiber sampled had cooled below the melting (resolidification) point of the polyethylene sheath. The conditioned response temperatures for each sample are given below.

| Sample | Conditioned Response Temperature |
|---|---|
| 1 | 96° C. |
| 2 | 93° C. |
| 3 | 69° C. |
| 4 | 60° C. |
| 5 | 64° C. |
| 6 | 114° C. |

EXAMPLE 6

A staple fiber consisting of the high density polyethylene and the polyester of Example 1, arranged in an eccentric sheath/core relationship at 50% by weight of sheath and 50% by weight of core was spun from separate screw extruders for each polymer. In spinning, each polymer is metered to the spinneret at the rate of 0.50 grams/minute/hole, or a total throughput for both polymers of 1.000 gram/minute/hole. Each spinneret hole had a diameter of 400μ. The filaments so extruded are cooled, a spin finish conventional for polyolefins applied by water wheel, and the tow would at 1000 m/min. The filaments are drawn through a water bath at 70° C. to a ratio of 2.50, and then through another water bath at 85° C. to a ratio of 1.3. The total ratio of drawing was thus 3.25. The tow was crimped by conventional stuffer box crimping, then treated under no tension in forced air heat for 300 seconds at 90° C. to develop the conditioned response desired. The fiber, cut into 1½ inch staple, had typical values as follows:

Denier—5.37 dpf
Tenacity—1.95 gpd
Elongation—81.8%
Crimp/Inch—31

A single sample of the fiber thus prepared was subjected to thermal stress analysis, as in Example 1. No substantial tensile forces developed during the heating phase of the test, but tension did develop during the cooling phase after the fiber sample had cooled below the melting (resolidification) point of the polyethylene sheath. The conditioned response temperature for the sample was 98° C.

EXAMPLE 7

A staple fiber consisting of a sheath composed of a 33 MFI Polypropylene (Fortilene HY-602A obtained from Soltex Polymers Corp.), and a core consisting of a standard fiber grade of semi-dull polyester was spun in an eccentric sheath/core arrangement into a fiber of about 50% by weight of polypropylene and 50% by weight of polyester. The melting point of the polypropylene was 162° C. The melting point of the polyester was 260° C.

The polypropylene and the polyester were melted in separate screw extruders, and spun and wound as specified in Example 1. The filaments were drawn at a ratio of 2.6 to develop maximum orientation, and, thusly, textile fiber properties. After conventional stuffer-box crimping to aid in textile processing as a staple fiber, the tow was thermally conditioned under no tension for 240 seconds at 230° F. (110° C.). Fiber prepared thusly had typical values as follows:

Denier—2.60 dpf
Tenacity—4.04 gpd
Elongation—20.2%
Crimp/Inch—12

In order to highlight the effect of a fiber's thermal history upon the temperature and time parameters which must be observed in order to achieve the desired thermal response according to the invention, a thermal stress analysis was run on two samples of the above fiber in the manner prescribed in Example 1. While the thermal conditioning used to this point in the present Example was the same as in Example 1, the results of the thermal stress analysis were not. As in the desired thermal response, no shrinkage force was seen during the heating phase of the two tests. Very notably, however, significant tension build up was seen to occur in both samples during the cooling phase at conditioned response temperatures which were much above those recorded in Example 1. Specifically, the conditioned response temperatures were about 136° C. and 137° C. Without wishing to be bound by any particular theory, it is clear than the polyester component of the fiber of the present Example experienced a thermomechanical history which was different from that of the fiber produced in Example 1, due mostly to the use of a higher melting sheath material, which was introduced to the core at a higher temperature, and that this different thermo-mechanical history produced a conditioned response in the fiber which was unlike that seen in Example 1.

In order to highlight the importance of the melting point of the sheath material, which in the case of polypropylene was 162° C., a thermal stress analysis was carried out on four samples of the fiber as in the manner prescribed in Example 1, except that the peak temperature reached was 200° C., a temperature at which the fiber of the present Example might typically be bonded into a nonwoven. One effect of the high peak temperature utilized was the buildup of shrinkage force in each of the samples during the heating phase of the tests, something not seen when the fiber only heated to 150° C. In addition, it was noted that the buildup of tension during the cooling phase of the tests occurred at a much higher temperature in all but one instance.

To produce fibers of the present Example having a conditioned thermal response in keeping with the requirements of the invention, the fiber prepared thus far was subjected to an additional thermal conditioning step which involved heating the fiber at 140° C. for 300 seconds. Two samples of the thus treated fiber were then subjected to thermomechanical analysis as in Example 1, except that a peak temperature of 200° C. was reached. The fibers exhibited the thermal response which characterizes fibers in accordance with the present invention. This is to say, no substantial shrinkage force was observed in either sample during heating, while both samples did exhibit a substantial shrinkage force upon cooling, but only after cooling well below 162° C., the resolidification point of the sheath material. The conditioned response temperatures for the two samples were approximately 110° and 135° C.

Lastly, to show the effect of an excessive thermal conditioning treatment, a second batch of fiber was subjected to an additional thermal conditioning step, as described above, which this time involved heating the fiber at 145° C. for 300 seconds. Two samples of this fiber were prepared and subjected to thermal mechanical analysis, with the peak temperature reached once again being 200° C. In the case of both samples, no tension buildup was seen upon either heating or cooling.

While the invention has been described with reference to certain specific examples and illustrative embodiments, it is, of course, not intended to be so limited except insofar as appears in the accompanying claims.

We claim:

1. A method for producing a heterofilament of the type comprising a latently adhesive component for forming interfilamentary bonds upon the application of heat and subsequent cooling, and a fiber component consisting of polyester, said heterfilament being characterized by a thermomechanical response wherein, upon the application of heat sufficient to melt the latently adhesive component and subsequent cooling, shrinkage force greater than about 0.01 g/denier appears in said fiber component only after the resolidification of said latently adhesive component; said method comprising the sequential steps of:

(a) spinning said fiber; and (b) subjecting said fiber to a thermal conditioning treatment wherein said fiber is heated to a preselected temperature below the softening point of the lower melting component for at least a preselected time in order to bring about in said fiber the above described thermo-mechanical response.

2. The method of claim 1, further including the sequential step of drawing said fiber prior to said thermal conditioning treatment.

3. The method of claims 1 or 2, wherein said latently adhesive component is polyethylene.

4. The method of claims 1 or 2, wherein said latently adhesive component is polypropylene.

5. The method of claim 3, wherein said thermal conditioning treatment temperature falls within the range of from about 90° C. to 120° C. and wherein said treatment time falls within the range of from about 180 seconds to 300 seconds.

6. The method of claim 4, wherein said fiber is heated to at least about 300 seconds for at least about 140° C.

7. The method of claim 2, wherein said fiber is wound subsequent to said drawing step.

* * * * *